United States Patent [19]

Ohe et al.

[11] Patent Number: 4,816,837

[45] Date of Patent: Mar. 28, 1989

[54] AUTOMOBILE ANTENNA SYSTEM

[75] Inventors: Junzo Ohe, Toyota; Hiroshi Kondo, Okazaki, both of Japan

[73] Assignee: Toyota Jidosha Kabushiki Kaisha, Toyota, Japan

[21] Appl. No.: 891,180

[22] Filed: Jul. 31, 1986

[30] Foreign Application Priority Data

Aug. 1, 1985 [JP] Japan ..... 60-170917

[51] Int. Cl.[4] ..... H01Q 1/32

[52] U.S. Cl. ..... 343/713; 343/866; 343/895

[58] Field of Search ..... 343/711, 712, 713, 866, 343/895

[56] References Cited

U.S. PATENT DOCUMENTS

| | | | |
|---|---|---|---|
| 2,200,674 | 5/1940 | McDonald, Jr. | 343/702 |
| 2,212,253 | 8/1940 | Stief | 343/715 |
| 2,404,093 | 7/1946 | Roberts | 343/708 |
| 2,481,978 | 9/1949 | Clough | 343/712 |
| 2,520,986 | 9/1950 | Williams et al. | 343/712 |
| 2,575,471 | 11/1951 | Schweiss et al. | 343/712 |
| 2,740,113 | 3/1956 | Hemphill | 343/787 |
| 2,774,811 | 12/1956 | Shanok et al. | 343/711 |
| 2,859,441 | 11/1958 | Rosenbaum | 343/712 |
| 2,950,479 | 12/1960 | Pan | 343/702 |
| 2,971,191 | 2/1961 | Davis | 343/712 |
| 3,007,164 | 10/1961 | Davis | 343/712 |
| 3,066,293 | 11/1962 | Davis | 343/767 |
| 3,210,766 | 10/1965 | Parker | 343/743 |
| 3,364,487 | 1/1968 | Maheux | 343/702 |
| 3,611,388 | 10/1971 | Okumura | 343/712 |
| 3,717,876 | 2/1973 | Volkers et al. | 343/712 |
| 3,728,732 | 4/1973 | Igarashi | 343/713 |
| 3,742,508 | 6/1973 | Tomaszewski | 343/713 |
| 3,794,997 | 2/1974 | Iwatsuki et al. | 343/712 |
| 3,823,403 | 7/1974 | Walter et al. | 343/744 |
| 3,916,413 | 10/1975 | Davis | 343/712 |
| 3,961,292 | 6/1976 | Davis | 343/712 |
| 3,961,330 | 6/1976 | Davis | 343/712 |
| 3,972,048 | 7/1976 | Davis | 343/712 |
| 4,003,056 | 1/1977 | Davis | 343/713 |
| 4,080,603 | 3/1978 | Moody | 343/712 |
| 4,217,591 | 8/1980 | Czerwinski | 343/713 |
| 4,278,980 | 7/1981 | Ogita et al. | 343/748 |
| 4,317,121 | 2/1982 | Allen, Jr. | 343/712 |
| 4,339,827 | 7/1982 | Torres et al. | 343/748 |
| 4,499,606 | 2/1985 | Rambo | 455/277 |
| 4,506,267 | 3/1985 | Harmuth | 343/744 |

FOREIGN PATENT DOCUMENTS

| | | | |
|---|---|---|---|
| 0181765 | 6/1983 | European Pat. Off. . | |
| 0181120 | 5/1986 | European Pat. Off. . | |
| 0182497 | 5/1986 | European Pat. Off. . | |
| 0181200 | 5/1986 | European Pat. Off. . | |
| 0183443 | 6/1986 | European Pat. Off. . | |
| 0183523 | 6/1986 | European Pat. Off. . | |
| 0183520 | 6/1986 | European Pat. Off. . | |
| 0183521 | 6/1986 | European Pat. Off. . | |
| 889618 | 9/1953 | Fed. Rep. of Germany . | |
| 1131762 | 6/1962 | Fed. Rep. of Germany . | |
| 1949828 | 10/1968 | Fed. Rep. of Germany . | |
| 7015306 | 9/1970 | Fed. Rep. of Germany . | |
| 2425189 | 12/1974 | Fed. Rep. of Germany . | |
| 2701921 | 7/1978 | Fed. Rep. of Germany . | |
| 2745475 | 4/1979 | Fed. Rep. of Germany . | |
| 2821202 | 11/1979 | Fed. Rep. of Germany . | |
| 2733478 | 4/1980 | Fed. Rep. of Germany . | |
| 53-22418 | 8/1978 | Japan . | |
| 60-046617 | 4/1980 | Japan . | |
| 59-44861 | 3/1984 | Japan . | |
| 0172804 | 9/1984 | Japan | 343/713 |
| 60-129464 | 8/1985 | Japan . | |

OTHER PUBLICATIONS

Translation of DE-OS 1 949 828, specification and claims only, Summary of the Inventions (Utility Model Publications Nos. 60-1008, 60-1009, 60-1010, 60-1011, 60-1012, Patent Publications Nos. 60-172804, 55-88407.

*Primary Examiner*—William L. Sikes
*Assistant Examiner*—Hoanganh Le
*Attorney, Agent, or Firm*—Cushman, Darby & Cushman

[57] ABSTRACT

An automobile antenna disclosed is built in within a vehicle body without any externally protruding portion. It includes an electromagnetic coupling type high-frequency pickup, which has a loop antenna disposed in close proximity to a marginal edge of the vehicle body so as to electromagnetically detect the high-frequency surface currents induced on the vehicle body by external electrical waves.

The loop antenna is formed into a coil of a plurality of turns so that it has a resonance characteristic with respect to frequencies in a broad band by virtue of the self inductance and the parasitic capacitance of the coil.

7 Claims, 5 Drawing Sheets

AUTOMOBILE ANTENNA SYSTEM

BACKGROUND OF THE INVENTION

1. Field of the Invention

The present invention relates to an automobile antenna system and more particularly, to an improved automobile antenna system for effectively detecting broadcast waves received by the vehicle body of an automobile and supplying a detection signal to various receivers installed in the vehicle body.

2. Description of the Prior Art

Antenna systems are indispensable to automobiles which must positively receive various broadcast waves such as those for radio, television and telephone at the receivers located within the vehicle. Such antenna systems are also very important for citizen band transceivers. Therefore, such antenna systems play an important role in the communication equipment which will be installed as a factory-installed item in the car of the future.

One of the conventional antenna systems is generally known as a pole antenna which projects outwardly from the vehicle body. Although such a pole antenna is superior in performance, it always remains a nuisance from the viewpoint of vehicle body design.

Furthermore, such a pole antenna is disadvantageous in that it is subject to damage, tampering or theft and also in that the antenna tends to generate noise during high-speed driving. For these reasons, there has heretofore been a strong desire to eliminate the need for such pole antennas.

With the enlargement of the frequency bands for broadcasting or communication waves received at automobiles in recent years, a plurality of pole antennas have been required in accordance with respective frequency bands. This brings about other problems; a plurality of pole antennas detracts from the aesthetic appearance of the automobile, and the receiving performance is greatly deteriorated by electrical interference between the antennas.

Various efforts have hitherto been made to eliminate the pole antenna system or to conceal it from the exterior. One such proposal has been to paste a small-gauge antenna wire on the rear windshield of an automobile, and this proposal has been put to practical use.

Another type of improved TV antenna system has been proposed which detects the surface currents induced on a vehicle body by broadcast waves. Although utilization of currents which flow on the vehicle may apparently be the most reliable and efficient means, experiments carried out heretofore have shown very unfavorable results.

The first reason why the surface currents on an ordinary vehicle body cannot be effectively utilized is that the value of the surface currents has proved to be lower than expected so that it has not been possible to obtain a detecting output from the surface currents on the roof panel of a vehicle body (the portion mainly used for detection) that is at a high enough level.

Another reason is that surface currents often have noise mixed therein. This noise is mainly produced by the engine ignition system of the vehicle and its battery charging regulator system, and it leaks into the vehicle body during the operation of the engine. It is therefore impossible to realize reception of broadcast waves in a clear enough manner for this system to be put to practical use.

In spite of such an unfavorable situation, some proposals have hiterto been made to overcome the above problems. One such proposal is disclosed in Japanese Patent Publication No. 22418/1978. In this antenna system, an electrical insulation is formed at a portion of the vehicle body on which currents are concentrated, with the currents being detected directly by a sensor between the opposite ends of the insulation. Although such structure can detect utilizable signals which are superior in SN ratio, a pickup used therein requires a particular cutout in the vehicle body. This cannot be accepted in the mass-production of automobiles.

Another proposal is disclosed in Japanese Utility Model Publication No. 34826/1978 in which an antenna including a pickup coil is provided for detecting currents flowing in a pillar of the vehicle body. This system is advantageous in that the antenna can be disposed completely within a vehicle body. However it is not practical for the pickup coil used therein to be located adjacent to the vehicle pillar in a direction perpendicular to the longitudinal axis of the pillar. Thus, it also appears that this arrangement cannot pick up any utilizable output of the antenna.

As has been described above, the conventional antenna systems have not been successful in efficiently detecting currents induced on the vehicle body by broadcast waves.

No effective measure has heretofore been proposed for overcoming the above-described problems of the conventional art in providing, in particular, a pickup structure for effectively detecting currents induced on the vehicle body by broadcast waves and a pickup arrangement capable of obtaining a utilizable SN ratio.

Furthermore, in the conventional antenna systems the receiving sensitivity is low and varies in accordance with a frequency band.

SUMMARY OF THE INVENTION

Accordingly, it is an object of the present invention to provide an automobile antenna system which is capable of effectively detecting the currents induced on a vehicle body by the broadcast waves of a desired frequency and transmit them to the receivers installed in the vehicle body.

To achieve this aim, the present invention provides an antenna system composed of a high-frequency pickup which is provided in proximity to a marginal edge of a vehicle body to detect high-frequency surface currents of more than a predetermined frequency. The high-frequency pickup is characterized by a loop antenna of a wound coil provided on the side which faces the marginal edge of the vehicle body.

In other words, the element of the loop antenna in accordance with the present invention which is in contact with the marginal portion of the vehicle body is a spiral coil, so that frequencies in a broad band resonate by virtue of the self inductance and the parasitic capacitance of the coil, thereby enjoying reception of high sensitivity.

A conventional antenna system is mainly aimed at reception of AM waves to meet the demands of the times. However, the wavelength of such broadcasting waves is too long for the antenna which detects the currents on a vehicle body, and good receiving characteristics cannot be obtained with respect thereto. The present invention took notice of these frequency dependency characteristics, and the broadcast waves which the present invention aimed to deal with are limited to the broadcast waves of more than the FM frequency, ordinarily, high-frequency broadcast waves of more than 50 MHz. This approach has enabled very effective reception from the currents on a vehicle body to be obtainable, which has conventionally been considered to be impossible.

The above and other objects, features and advantages of the present invention will become clear from the following description of the preferred embodiment thereof, taken in conjunction with the accompanying drawings.

DESCRIPTION OF THE PREFERRED EMBODIMENT

A preferred embodiment of an automobile antenna system according to the present invention will be described hereinunder with reference to the accompanying drawings.

Figure 9:
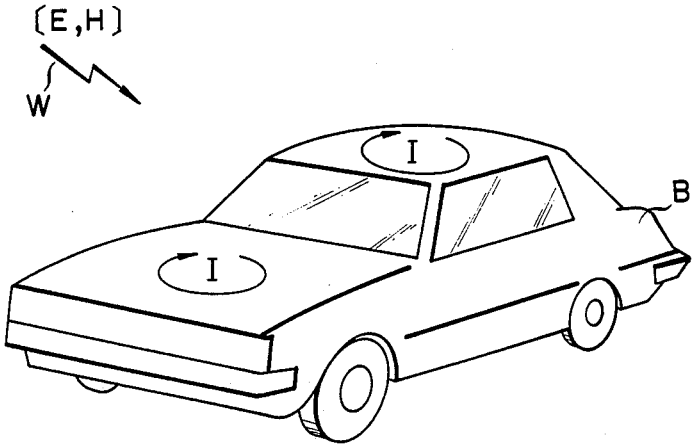
FIG. 9 is an explanatory view of the surface currents I produced on the vehicle body B by external waves W.

FIG. 9 shows that when external electromagnetic waves W, such as broadcast waves, pass through the vehicle body B of conductive metal, surface currents I are induced at various vehicle locations at levels corresponding to the intensities of electromagnetic waves passing therethrough. The present invention aims at only electromagnetic waves of relatively high frequency bands in excess of 50 MHz, such as FM broadcast waves and TV waves.

The present invention is characterized in that the distribution of the surface currents induced on the vehicle body by electromagnetic waves within the above-described particular wave bands is measured so as to seek a location on the vehicle body which is higher in surface current density and lower in noise and at which a pickup used in the present invention is located.

The distribution of surface currents is determined by a simulation using a computer and also by measuring actual intensities of surface currents at various locations on a vehicle body. In accordance with the present invention, the measurement is carried out by the use of a probe which can operate in accordance with the same principle as that of a high-frequency pickup actually located on the vehicle body at a desired location, as will be described later. Such a probe is moved on the vehicle body throughout the entire surface thereof to measure the level of surface currents at various locations of the vehicle body.

Figure 10:
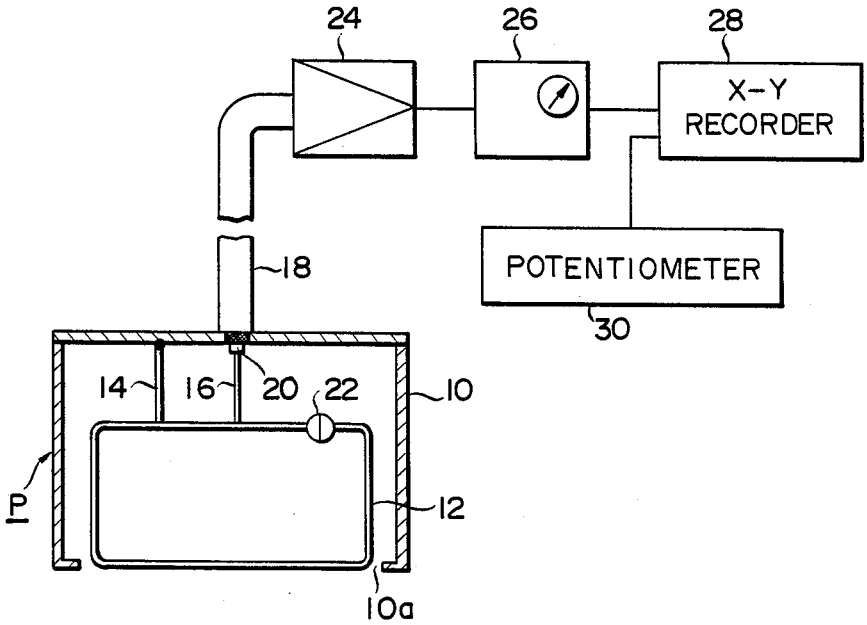
FIG. 10 illustrates a probe for detecting the distribution of surface currents on the vehicle body and having the same construction as that of the high-frequency pickup used in the present invention, and a circuit for processing signals from the probe.

FIG. 10 shows an example of such a probe P which is constructed in accordance with substantially the same principle as that of the high-frequency pickup described hereinafter. The probe P is composed of a casing 10 of an electrically conductive material for preventing any external electromagnetic wave from transmitting to the interior thereof and a loop coil 12 fixed within the casing 10. The casing 10 includes an opening 10a formed therein through which a portion of the loop coil 12 is externally exposed. The exposed portion of the loop coil 12 is located in close proximity to the surface of the vehicle body B to detect magnetic flux induced by surface currents on the vehicle body B. Another portion of the loop coil 12 is connected with the casing 10 through a short-circuiting line 14. The loop coil 12 further includes an output end 16 connected with a core 20 in a coaxial cable 18. Still another portion of the loop coil 12 includes a capacitor 22 for causing the frequency in the loop coil 12 to resonate relative to the desired frequency to be measured to increase the efficiency of the pickup.

Thus, when the probe P is moved along the surface of the vehicle body B and also angularly rotated at various locations of measurement, the distribution and direction of surface currents can accurately be determined at each of the vehicle locations. In FIG. 10, the output of the probe P is amplified by a high-frequency voltage amplifying circuit 24 and the resulting output voltage is measured by a high-frequency voltmeter 26. This coil output voltage is read at the indicated value of the high-frequency voltmeter 26 and also is recorded by an XY recorder 28 to provide the distribution of surface currents at various vehicle locations. The input of the XY recorder 28 receives signals indicative of various vehicle locations from a potentiometer 30 to recognize the value of high-frequency surface currents at the corresponding vehicle location.

Figure 1:
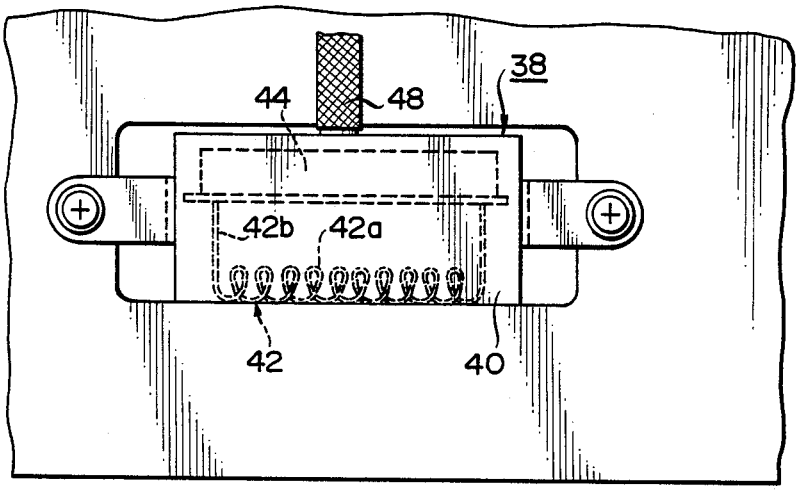
FIG. 1 is a plan view of a high-frequency pickup in accordance with the present invention which is attached to a vehicle body.
Figure 2:
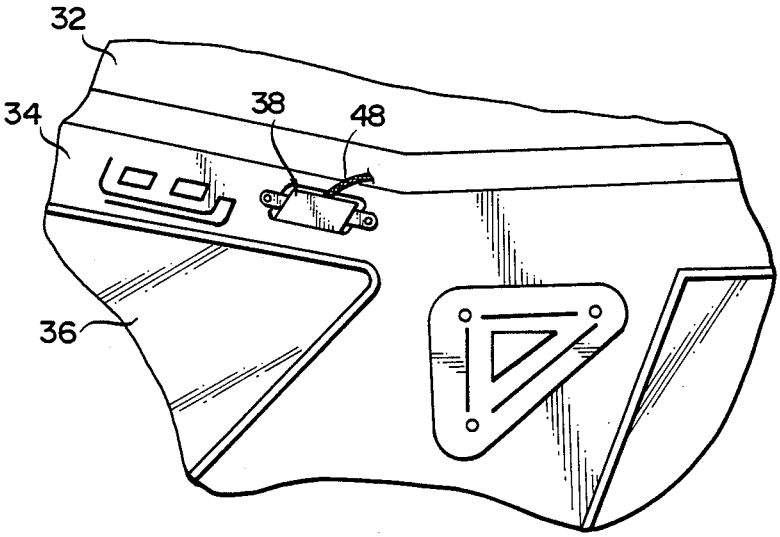
FIG. 2 is a perspective view of an electromagnetic coupling type high-frequency pickup which is attached to the rear window frame of the roof panel of an automobile.

FIGS. 1 and 2 show an embodiment of the present invention in which the high-frequency pickup is disposed in close proximity to the rear peripheral edge of a roof panel.

In FIG. 2, a roof panel 32 is exposed or coated with a coating material and this metal roof panel 32 is connected to a rear window glass 36 with a rear window frame 34 as its peripheral end.

In this embodiment, a high-frequency pickup 38 is provided on the rear window frame within the distance of $12\times10^{-3}\lambda$ ($\lambda$ represents the wavelength of broadcast waves) from the outer peripheral edge of the vehicle body.

As shown in detail in FIG. 1, the high-frequency pickup 38 includes a loop antenna 42 within a casing 40 and constitutes an electromagnetic coupling type pickup having a similar structure to the probe including a loop coil which is used for detecting the distribution of the surface currents of a vehicle body.

The present invention is characterized in that the high-frequency pickup 38 has the loop antenna 42 which is wound into a coil.

Figure 3:
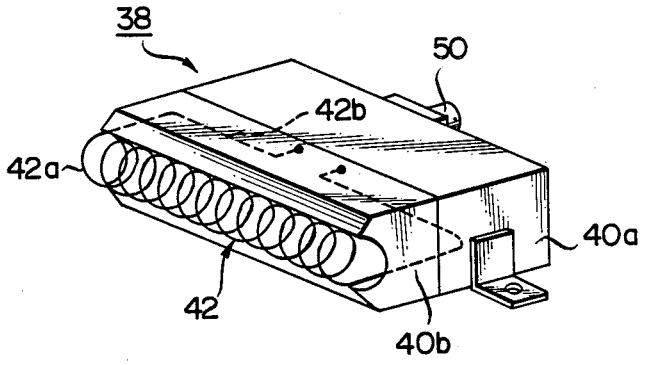
FIG. 3 is an external perspective view of the high-frequency pickup.
Figure 4:
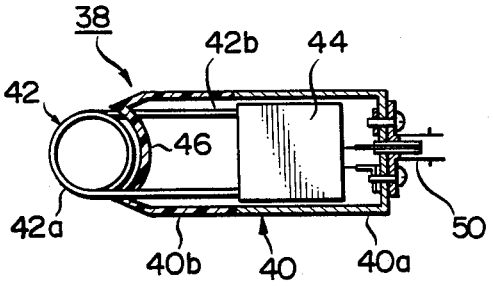
FIG. 4 is a sectional view of the high-frequency pickup shown in FIG. 3.
Figure 5:
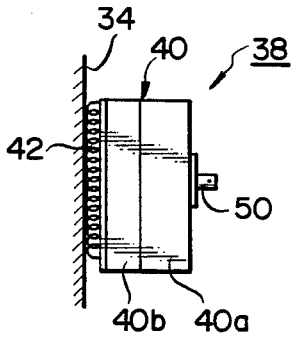
FIG. 5 is a schematic explanatory view of the high-frequency pickup which is in close contact with the vehicle body.

As shown in FIGS. 3 and 4, the loop antenna 42 is protruded from a circuitry 44 and includes a spiral coil portion 42*a* and a lead-out portion 42*b*. The signals detected are processed by an impedance matching circuit and an amplifying circuit provided in the circuitry 44. The high-frequency detection signals obtained in this way are fetched outward from a coaxial cable 48 through a BNC connector 50 to be transmitted to various receivers such as a radio and a television installed in the vehicle.

The exterior of the circuitry 44 is covered with a metal casing 40*a* which shields it from external electromagnetic waves, while the exterior of the lead-out portion 42*b* of the loop antenna 42 is covered with a resin casing 40*b* so that the external magentic flux is effectively detected. The resin casing 40*b* is provided with a holding arch 46 for holding the spiral coil portion 42*a*.

The coil 42*a* is covered with an insulation so that the loop antenna 42 is arranged in close contact with the rear window frame in an electrically insulated state therewith. The spiral coil portion 42*a* is slightly flexed such as to be pressed toward the rear window frame 34, whereby the flux caused by the surface currents is strongly interlinked with the loop antenna 42.

The present invention is also characterized in that the antenna system can resonate frequencies in a desired frequency band by virtue of the self inductance and the parasitic capacitance (capacitance generated between both ends of the loop), thereby enjoying highly sensitive reception. The diameter of the coil of the loop antenna 42 is about 1 cm in this embodiment, and the number of turns can be determined in accordance with a desired frequency.

Figure 6:
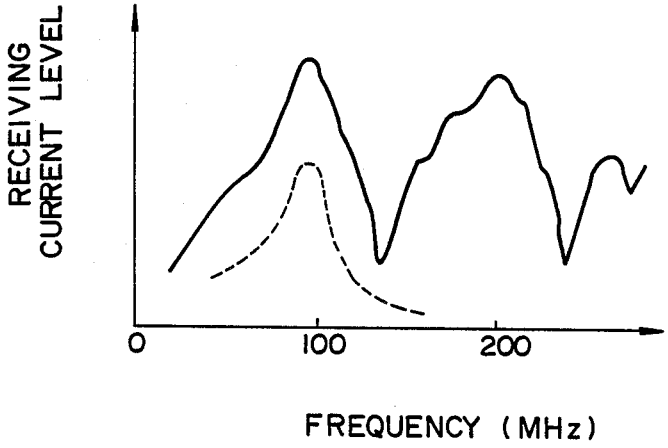
FIG. 6 shows a relationship between the frequency band and the reception level in an automobile antenna system according to the present invention.

For example, as shown in FIG. 6 which shows the relationship between the frequency band and the reception level, if the first resonance is required at approximately 100 MHz, about a 20 to 30-turn coil can realize it.

In this case, the length of the loop antenna 42 is about 10 cm, and the resonant points in the embodiment appear at a multiplicity of times the frequency at the first resonant point. For example, if the first resonant point is set at the center of 70 to 110 MHz of the TV broadcasting VHF (Lo) band in Japan, namely, 90 MHz, then the second resonant point is at 180 MHz of the TV broadcasting VHF (Hi) band in Japan, wherein a highly sensitive characteristic is obtained.

The broken line in FIG. 6 shows the parallel resonance type sensitivity characteristic of a single loop antenna. As is obvious from the graph, the sensitivity characteristic in this embodiment is enhanced by about 5 to 10 dB in comparison with the single loop antenna.

Figure 7:
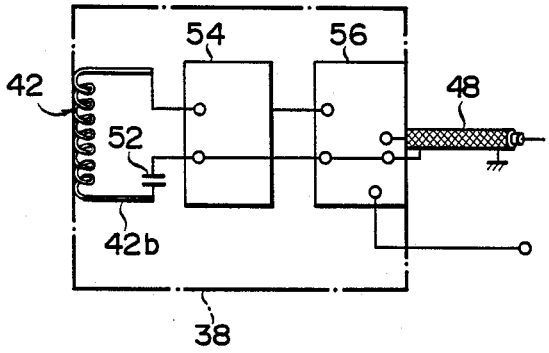
FIG. 7 is a schematic circuit diagram for the high-frequency pickup.

Referring to FIG. 7, the casing 40 of the high-frequency pickup 30 accommodates the impedance matching circuit 54 and the amplifying circuit 56 as the integral circuitry 44, and the output impedance of the amplifying circuit 56 and the characteristic impedance of the coaxial cable 48 agree, thereby enabling very effective signal processing.

In FIG. 7, a capacitor 52 is connected to the loop antenna 42 in series. The and the impedance of the signal detected by the loop antenna 42 is matched by the impedance matching circuit 54. The detected signal is amplified at a high frequency by the amplifying circuit 54 in the next step, and is fetched from the coaxial cable 48 to a receiver installed in the vehicle. If the capacitor 52 is a variable capacitor, fine adjustment of the resonance frequency is possible.

Figure 8:
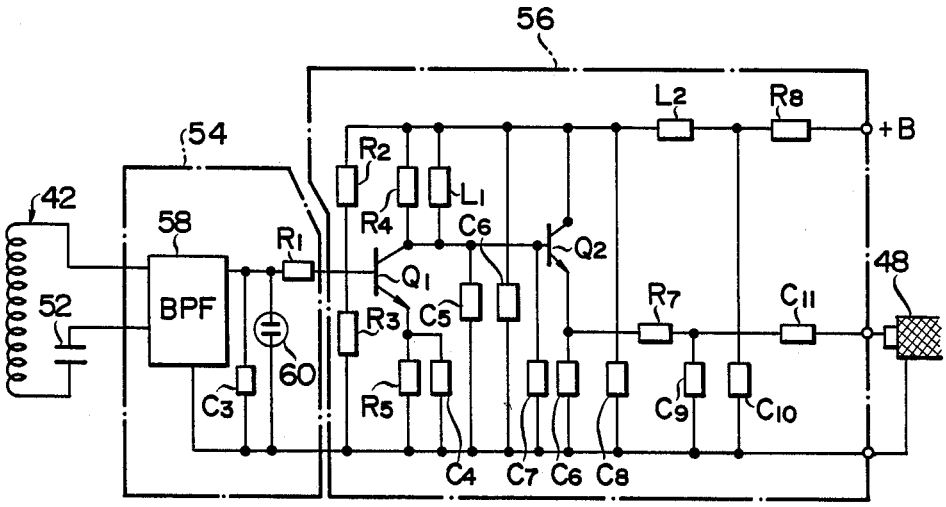
FIG. 8 is a detailed circuit diagram for the high-frequency pickup shown in FIG. 7.

FIG. 8 shows a concrete circuit structure of the circuit shown in FIG. 7. Both the connection of the circuits and the operation thereof will be explained at the same time in the following.

The impedance matching circuit 54 includes a band-pass filter 58 and a discharge tube 60, and the voltage of the loop antenna 42 detected by the capacitor 52 is input to the band-pass filter 58. The output of the band-pass filter 58 is supplied to the parallel circuit of the discharge tube 60 and a capacitor $C_3$.

The discharge tube 60 is provided for the purpose of protecting the antenna from electrostatic breakdown, and prevents the circuit from being broken by external static electricity thunder or the like. The band-pass filter also matches the impedance of the loop antenna 42.

The detection signal which has been subjected to impedance matching in this way is input to the high-frequency amplifying circuit 56 for high-frequency amplification.

The amplifying circuit 56 includes transistors $Q_1$ and $Q_2$ which are connected in two stages and the output thereof is supplied from the coaxial cable 48 to the receiver.

In FIG. 8, the inductances $L_1$, $L_2$ denote peaking coils, the resistors $R_2$, $R_3$ resistors for stabilizing the action of the transistor $Q_1$, the resistors $R_5$, $R_6$ bias resistors, and the symbols $C_3$, $C_9$ bypass capacitors.

The coating of a conductor material of the coaxial cable 48 is grounded and constitutes a ground lead of the impedance matching circuit 54 and the high-frequency amplifying circuit 56 provided in the casing.

The output impedance of the high-frequency amplifying circuit 56 and the characteristic impedance of the coaxial cable 48 are at approximately the same value, thereby maintaining good matching between the high-frequency amplifying circuit 56 and the coaxial cable 48.

As described above, according to the present invention, a desired impedance matching and high-frequency amplification of a feeble signal detected by the loop antenna 42 are conducted within the casing 40 where the signal is detected, and these circuits are small enough to be accommodated in the casing 40. The signal fetched from the coaxial cable 48 is so stable that broad-band reception of FM or TV broadcast waves is enabled with efficience and high sensitivity.

In this way, an automobile antenna system according to the present invention utilizes the high-frequency surface currents induced by broadcast waves in comparatively high-frequency bands, e.g., broadcast waves of more than the FM frequency, at specific portions of a vehicle body, particularly, at marginal portions of a vehicle body, and is composed of a high-frequency pickup which includes a loop antenna in the shape of a coil. As a result, the antenna is able to have a resonance characteristic with respect to frequencies in a wide band by virtue of the self inductance and the parasitic capacitance of the coil, thereby performing highly sensitive reception.

While there has been described what is at present considered to be a preferred embodiment of the invention, it will be understood that various modifications may be made thereto, and it is intended that the appended claims cover all such modifications as fall within the true spirit and scope of the invention.

We claim:

1. An automobile antenna system comprising:

a high-frequency pickup which is longitudinally disposed in proximity to and insulated from a marginal edge of a vehicle body of an automobile so as to electromagnetically detect the high-frequency surface currents induced on said vehicle body by broadcast waves;

said high-frequency pickup being provided with a loop antenna consisting of a coil of a plurality of turns on the side facing the marginal edge portion of said vehicle body;

said high-frequency pickup further including a casing fixed to said marginal edge portion of said vehicle body and circuitry provided in said casing, said loop antenna having a spiral coil protruding from said circuitry and being connected thereto.

2. An automobile antenna system according to claim 1, wherein said circuitry includes an impedance matching circuit to which said loop antenna is connected, and an amplifying circuit for amplifying the output of said impedance matching circuit at a high frequency, and the output of said amplifying circuit is supplied to a receiver installed in said vehicle body through a coaxial cable.

3. An automobile antenna system according to claim 1, wherein a variable capacitor is connected to said loop antenna so as to perform fine adjustment of a resonance frequency.

4. An automobile antenna system according to claim 1, further comprising mounting means for mounting the casing of said high-frequency pickup at a peripheral edge portion of a roof panel of said vehicle body.

5. An automobile antenna system according to claim 1, said loop antenna having a coil diameter of about 1 cm.

6. An automobile antenna system according to claim 1, said loop antenna having from 20 to 30 turns in the coil.

7. An automobile antenna system according to claim 1, said loop antenna being coated with insulation.

* * * * *